United States Patent [19]

Watts et al.

[11] 4,441,864

[45] Apr. 10, 1984

[54] HYDRAULIC PUMP WITH A MAGNETICALLY OPERATED COUPLING

[76] Inventors: Jeffrey E. Watts, 50 Anderson Ave., Westbrook, Me. 04092; Edward E. Watts, Star Rte., Manchester Rd., Steep Falls, Me. 04085

[21] Appl. No.: 233,450

[22] Filed: Feb. 11, 1981

[51] Int. Cl.[3] ..... F04B 9/00

[52] U.S. Cl. ..... 417/319

[58] Field of Search ..... 417/313, 319, 318; 123/195 A, 198 R, 198 C

[56] References Cited

U.S. PATENT DOCUMENTS

| | | | |
|---|---|---|---|
| 1,860,638 | 5/1932 | Walker | 417/364 |
| 2,264,560 | 12/1941 | Albertson | 417/248 |
| 2,651,262 | 9/1953 | Mathews | 123/398 |
| 3,871,793 | 3/1975 | Olson, Jr. | 417/319 X |
| 4,169,360 | 10/1979 | Shimizu | 417/319 X |
| 4,203,710 | 5/1980 | Farr | 417/313 X |

*Primary Examiner*—Lloyd L. King

[57] ABSTRACT

A hydraulic pump for attachment to a motor vehicle has a shaft extending freely through an attached hub on which an electro magnet is fixed and a pulley rotatably mounted. A clutch disc is fixed on the outer end of the pump shaft and is coupled to the pulley when the electro magnet is energized. The pump shaft is supported by an internal bearing and a bearing adjacent the clutch disc and fitted within the hub.

5 Claims, 3 Drawing Figures

HYDRAULIC PUMP WITH A MAGNETICALLY OPERATED COUPLING

BACKGROUND REFERENCES

U.S. Pat. No. 1,860,638;
U.S. Pat. No. 2,264,560;
U.S. Pat. No. 2,651,262.

BACKGROUND OF THE INVENTION

It is, of course, well known that such units as air conditioners, generators, and hydraulic pumps, when driven by the engines of motor vehicles, adversely affect fuel economy.

The prior art provides for the disconnection, removal and replacement on a convenient basis of the belts by which hydraulic pumps are driven. While the air conditioners with which motor vehicles are equipped have the pulleys connected to the drive shafts of the compressors only when electro magnets are energized, as far as we are aware, the hydraulic pumps of motor vehicles have not been equipped with electro-magnetically operated clutches.

THE PRESENT INVENTION

The general objective of the present invention is to provide means enabling commercially available, electro-magnetically operated clutches to be attached to commercially available hydraulic pumps of the type mounted on motor vehicle engines for use in operating equipment attached to that vehicle or hydraulic pumps and to pumps provided with such clutches.

The pulley of such a clutch is supported by a ball bearing unit on the outer end of an elongated hub the inner end of which is attached to the front end of a hydraulic pump. In accordance with the invention, the pump has a shaft freely through the hub with a clutch disc attached to the exposed end and of a type that becomes coupled to the proximate face of the pulley when an electro magnet mounted on the hub is energized. Such a pump has an internal bearing in support of the pump drive shaft and a shaft bearing adjacent the clutch disc fitted within the hub.

Hydraulic pumps with which the invention is also concerned are of the type which is a sealed unit with its drive shaft supported by an internal bearing and its drive shaft exposed only to the extent required to enable a pulley to be fixed thereon.

In accordance with the invention, in order that such a pump may be equipped with an electro-magnetically operated clutch, an adapter shaft is provided having a socket enabling it to be easily attached to the drive shaft with its length such that its outer end is exposed and of a reduced diameter to enable the hub of the clutch disc to be secured thereto and with the axial extent of the shaft portion of reduced diameter such that a bearing may be fitted between it and the forward end of the elongated hub.

BRIEF DESCRIPTION OF THE DRAWINGS

The accompanying drawings illustrate a preferred embodiment of the invention of which

THE PREFERRED EMBODIMENT OF THE INVENTION

Figure 1:
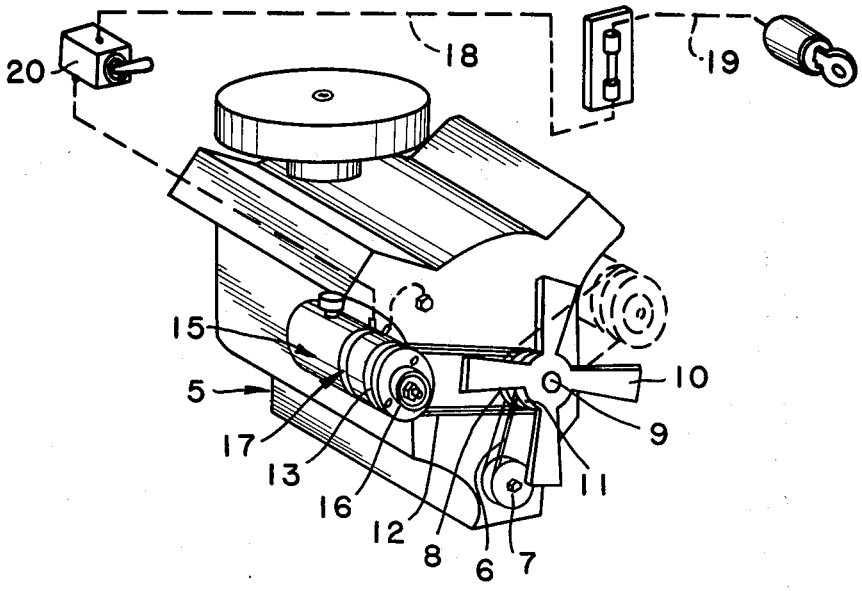
FIG. 1 is a somewhat schematic view of a motor vehicle engine with the pump for use in operating hydraulically operated equipment provided, in accordance with the invention, with a clutch enabling it to be driven by the power take off pulley.
Figure 2:
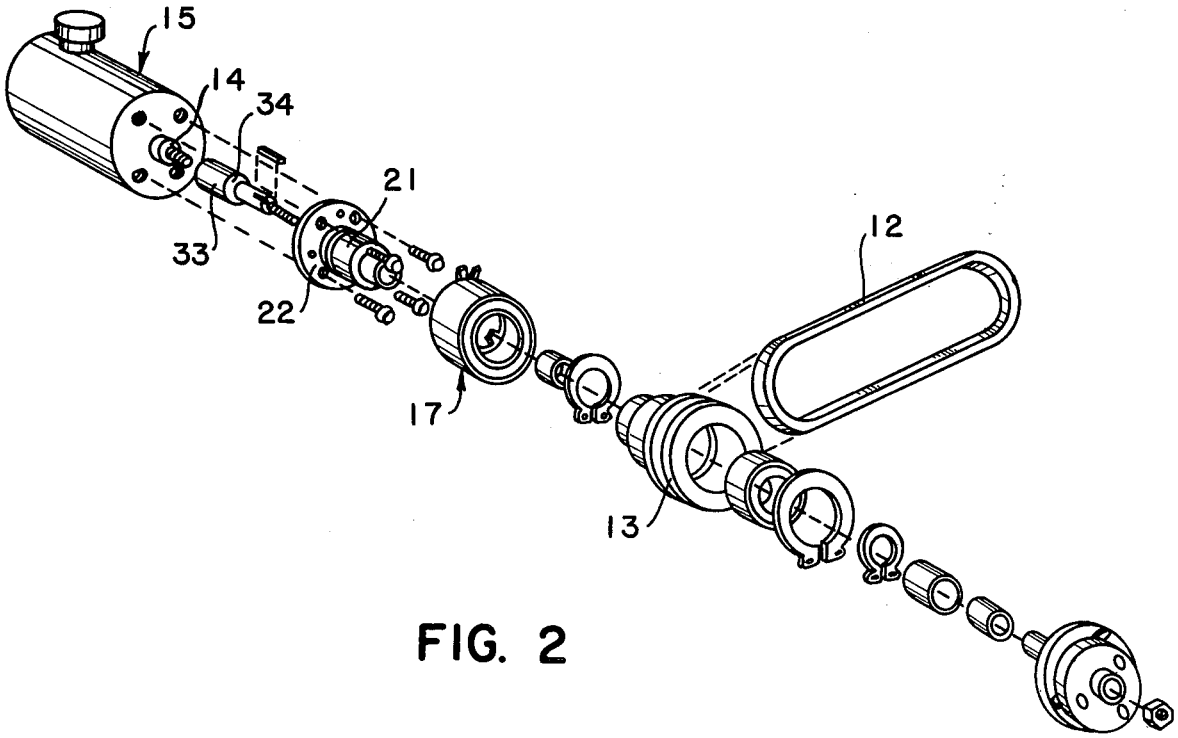
FIG. 2 is an exploded view of clutch components.
Figure 3:
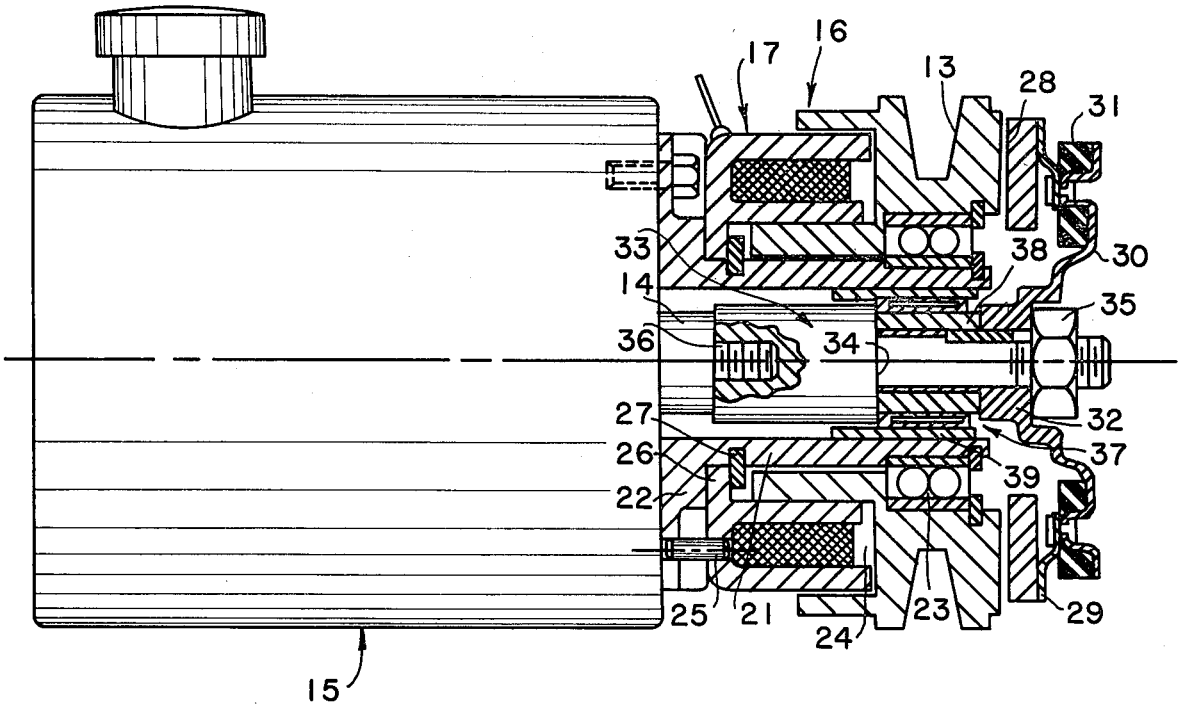
FIG. 3 is a longitudinal section, taken through the clutch and pulley.

In FIG. 1, a conventional small truck engine is generally indicated at 5. A belt 6 is trained about the crankshaft pulley 7 and a pulley 8 on the shaft 9 on which the fan 10 is secured. A power take-off pulley 11, coaxial and rotatable with the pulley 8 is connected by a belt 12 trained about a pulley 13 by which the shaft 14, see FIGS. 2 and 3, of a conventional hydraulic pump 15 is driven. Such a pump is sealed unit and its shaft 14 is supported by an internal bearing.

A commercially available clutch is generally indicated at 16 and has an electro-magnet, generally indicated at 17 and shown as included in an easily installed lead 18 connected to the ignition circuit 19 and provided with a manually operated switch 20 enabling the operator to engage and disengage the clutch with maximum ease and convenience.

The clutch 16 is or may be of the type used to place the air conditioner of a motor vehicle in service when needed and has an elongated hub 21 provided with a flange 22 easily bolted to the front end of the pump 15. The free end of the hub 21 supports the inner race of a ball bearing unit 23. The pulley 14 is recessed to accommodate the outer race of the ball bearing unit 23 the races of which are conventionally held in place by retaining rings.

The pulley 13 has a rearwardly opening annular chamber 24 with its inner wall longer than its outer wall. The chamber 24 freely receives the electro-magnet 17 the casing of which is held in place by pins 25 anchored in the flange 22 and by an internal supporting flange 26 seated on the hub 21 and held in place against the flange 22 by a retaining ring 27.

The outer face of the pulley 12 is engageable, when the electro-magnet 17 is energized by a responsive annulus 28 connected by a resilient ring 29 to the disc 30 carrying a shield 31 and provided with a hub 32.

In accordance with the invention and in order that such a clutch can be operatively connected to the pump shaft 14 an adapter shaft 33 is provided. The adapter shaft 33 has a shoulder 34 establishing a forward portion of a reduced diameter enabling the hub 32 of the disc to be splined thereto and anchored by a nut 34 threaded on the end thereof. The rear portion of the shaft 33 is a free fit within the hub 21 but is of a diameter enabling it to have a rearwardly opening threaded axial bore 36 so that the shaft 33 may be threaded on the exposed end of the pump shaft 15.

The forward portion of the adapter shaft 33 is of a length such that a bearing may be interposed between it and the hub 21 to ensure against failure of the internal pump shaft bearing due to the length of the adapter shaft. For this purpose, the use of a needle bearing 37 is preferred since it may be lubricated on the installation of the clutch 16 and not again require attention. The inner race 38 of the needle bearing is confined between the shaft shoulder 34 and the disc hub 32 and is preferably of hardened steel. The outer race is shown having a spacer 39 between it and the hub 21 which extends rearwardly of the shoulder 34 and is spaced from the rear portion thereof.

It will thus be seen that the invention provides a simple and easily installed structure by which an installed hydraulic pump may easily have a conventional electro-magnetically operated clutch attached thereto. It should be noted that because of the increase in length resulting from the addition of such a clutch, the bracket by which the pump 15 is mounted on the engine 5 must be modified or replaced to permit the pump 15 to be mounted the appropriate distance rearwardly of its original position. Such bracket changes are not shown as they differ with different engines.

We claim:

1. A hydraulic pump to be driven by a pulley having a belt trained about it and a pulley driven by the motor vehicle engine on which the pump is mounted, an elongated hub attached to the pump casing, a bearing unit rotatably supporting said pulley on the front end of the hub said pump including a drive shaft extending freely through the hub, an electro-magnet supported by said hub rearwardly of said pulley, a clutch disc including a portion engageable with said pulley only when said electro-magnet is energized and fixed on the free end of said shaft, and a bearing means fitted between said adapter shaft and the outer end of said hub substantially in radial alignment with said first bearing.

2. The hydraulic pump of claim 1 in which the shaft includes a first portion provided with a threaded end exposed externally of but close to the front end of the pump housing and an adapter portion the rear end of which is threaded to enable the adapter portion to be threaded on said threaded end and the forward portion of which is of reduced diameter, and the second bearing means is interposed between said reduced portion and said hub.

3. The hydraulic pump of claim 2 in which the bearing means is a needle bearing unit.

4. An adapter unit to enable an hydraulic pump of a type to be attached to and driven by a motor vehicle engine to be equipped with an electro-magnetically operated clutch of the type having a pulley rotatably mounted on an elongated hub attachable to the front end of the pump casing a clutch disc provided with a hub, the pump having a drive shaft with a threaded end exposed close to said front end, said unit including an adapter shaft the rear portion of which is a free fit within the hub and has a threaded bore in the rear end dimensioned to enable the adapter shaft to be threaded on the exposed end of the pump shaft and the front portion of which is of a reduced diameter such as to enable the clutch disc here to be secured thereon, and bearing means dimensioned to fit on said reduced portion and to be fitted within said hub in a position to be in radial alignment with said pulley.

5. The adapter unit of claim 4 in which the bearing unit is a needle bearing.

* * * * *